US005866292A

United States Patent [19]

Chamberlain et al.

[11] Patent Number: 5,866,292

[45] Date of Patent: Feb. 2, 1999

[54] LIQUID DEVELOPER COMPOSITIONS WITH COPOLYMERS

[75] Inventors: Scott D. Chamberlain, Macedon; David H. Pan, Rochester; Christopher M. Knapp, Fairport; John W. Spiewak, Webster; George A. Gibson, Fairport; Frank J. Bonsignore, Rochester, all of N.Y.

[73] Assignee: Xerox Corporation, Stamford, Conn.

[21] Appl. No.: 899,261

[22] Filed: Jul. 23, 1997

Related U.S. Application Data

[63] Continuation of Ser. No. 778,990, Jan. 6, 1997, Pat. No. 5,688,624.

[51] Int. Cl.[6] ..... G03G 9/135

[52] U.S. Cl. ..... 430/115; 430/119

[58] Field of Search ..... 430/115, 119, 430/117

[56] References Cited

U.S. PATENT DOCUMENTS

| | | | |
|---|---|---|---|
| 5,254,427 | 10/1993 | Lane et al. | 430/137 |
| 5,304,450 | 4/1994 | Paine | 430/137 |
| 5,525,450 | 6/1996 | Spiewak et al. | 430/115 |
| 5,554,469 | 9/1996 | Larson et al. | 430/31 |
| 5,563,015 | 10/1996 | Bonsignore et al. | 430/106 |
| 5,573,882 | 11/1996 | Larson et al. | 430/115 |
| 5,622,804 | 4/1997 | Matsuoka et al. | 430/115 |

FOREIGN PATENT DOCUMENTS

| | | |
|---|---|---|
| 0 542 051 A1 | 5/1993 | European Pat. Off. . |
| WO 92/00553 | 1/1992 | WIPO . |

*Primary Examiner*—John Goodrow
*Attorney, Agent, or Firm*—E. O. Palazzo

[57] ABSTRACT

A positively charged liquid developer comprised of a non-polar liquid, thermoplastic resin particles, pigment, a charge director, and a charge control agent comprised of a PEO:PPO, preferably in a solid form.

25 Claims, No Drawings

LIQUID DEVELOPER COMPOSITIONS WITH COPOLYMERS

This application is a continuation of application Ser. No. 08/778,990, filed Jan. 6, 1997 now U.S. Pat. No. 5,688,624.

PENDING PATENT APPLICATIONS

Illustrated in U.S. Pat. No. 5,627,002, the disclosure of which is totally incorporated herein by reference, is a liquid developer with certain cyclodextrins as charge control agents; in copending application U.S. Ser. No. 779,191; the disclosure of which is totally incorporated herein by reference, there is illustrated liquid developers with Rhodamine Y charge control agents; and in U.S. Ser. No. 778,855, the disclosure of which is totally incorporated herein by reference, there is illustrated liquid developers with a charge director of certain aluminum complexes.

BACKGROUND OF THE INVENTION

This invention is generally directed to liquid developer compositions and the excellent developed images obtained thereof, especially in electrographic image on image printing processes wherein a stylus provides, or writes the image pattern on a dielectric receptor, and more specifically, the present invention relates to a liquid developer containing certain charge control agents. More specifically, the present invention relates to positively charged liquid developers comprised of a nonpolar liquid, pigment, or dye, poly (ethylene oxide-b-propylene oxide) block copolymer (PEO:PPO), especially PEO:PPO Pluronic F-108, charge control agent (CCA) and a charge director, and which developers possess a number of advantages including the development and generation of images with improved image quality, especially with respect to four color, four pass ionographic development systems like the Xerox ColorgrafX 8900 printers, and wherein the developed images are of high quality and excellent resolution. The developers of the present invention in embodiments provide images with excellent, for from about 1.3 to about 1.4 reflective optical density (ROD) and/or especially lower residual voltages ($V_{out}$), for example less than about 45, and for example from about 25 to about 45. Higher reflective optical densities provide images with deeper, richer desirable color or more extended chroma. Lower residual image voltages enable the printing of subsequently applied layers to a higher reflective optical density and decrease or eliminate image defects, such as smearing and shifts in L*a*b* color space (hue shifts), when one colored layer is overlaid on a second layer of different color. Series-Capacitance Data was utilized as a means of measuring the total charge in the liquid developer formulation, and which measurements indicate that placing too much charge on the toner or developer particles can cause lower RODs to occur, which is a manifestation of inferior image quality because less chroma occurs. Moreover, there can be added to the liquid developers of the present invention in embodiments thereof charge directors of the formulas as illustrated in U.S. Pat. No. 5,563,015, especially a mixture of Alohas, an abbreviated name for aluminum-di-tertiary butyl salicylate, and EMPHOS PS-900™, or Alohas alone, an aluminum-di-tertiary butyl salicylate, the disclosure of this patent being totally incorporated herein by reference.

PRIOR ART

Developers can discharge the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems. Insufficient particle charge can result in poor image quality and also can result in poor transfer of the liquid developer or solids thereof to paper or other final substrates. Poor transfer can, for example, result in poor solid area coverage if insufficient toner is transferred to the final substrate and can also cause image defects such as smears and hollowed fine features. Conversely, overcharging the toner particles can result in low reflective optical density images or poor color richness or chroma since only a few very highly charged particles can discharge all the charge on the dielectric receptor causing too little toner to be deposited. To overcome or minimize such problems, the liquid toners, or developers of the present invention were arrived at after substantial research, and which developers result in, for example, sufficient particle charge to enable effective transfer but not so much charge as to yield images with lower optical densities and lower residual voltages because of excess toner charge. An advantage associated with the present invention includes controlling the increase of the desired positive charge on the developer particles.

A latent electrostatic image can be developed with toner particles dispersed in an insulating nonpolar liquid. These dispersed materials are known as liquid toners or liquid developers. A latent electrostatic image may be generated by providing a photoconductive imaging member or layer with a uniform electrostatic charge, and developing the image with a liquid developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 $\mu$m (microns) average by area size as measured with the Malvern 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate. As the copolymer with polyethylene and methacrylic acid or methacrylic acid alkyl esters, NUCREL® may be selected.

U.S. Pat. No. 5,030,535 discloses a liquid developer composition comprising a liquid vehicle, a charge control additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

Moreover, in U.S. Pat. No. 4,707,429 there are illustrated, for example, liquid developers with an aluminum stearate charge adjuvant. Liquid developers with charge directors are also illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

Illustrated in U.S. Pat. No. 5,306,591 is a liquid developer comprised of a liquid component, thermoplastic resin; an ionic or zwitterionic charge director, or directors soluble in a nonpolar liquid; and a charge additive, or charge adjuvant comprised of an imine bisquinone; in U.S. Statutory Invention Registration No. H1483 a liquid developer comprised of thermoplastic resin particles, and a charge director comprised of an ammonium AB diblock copolymer, and in U.S. Pat. No. 5,308,731 (a liquid developer comprised of a liquid, thermoplastic resin particles, a nonpolar liquid soluble charge director, and a charge adjuvant comprised of a metal hydroxycarboxylic acid, the disclosures of each of these patents and statutory invention registration being totally incorporated herein by reference.

SUMMARY OF THE INVENTION

Examples of objects of the present invention include:

It is an object of the present invention to provide a liquid developer with many of the advantages illustrated herein.

Another object of the present invention resides in the provision of a liquid developer capable of controlled or modulated particle charging for image quality optimization.

It is a further object of the invention to provide a positively charged liquid developer wherein there are selected as charge control agents or additives certain PEO:PPOs.

It is still a further object of the invention to provide positively charged liquid developers wherein developed image defects, such as smearing, loss of resolution and loss of density, and color shifts in prints having magenta images overlaid with black or other suitable colored images are eliminated or minimized.

Also, in another object of the present invention there are provided positively charged liquid developers with certain charge control agents that are in embodiments superior to liquid developers with no charge additive in that they result in higher reflective optical density (ROD) and/or lower residual ($V_{out}$) for developed images wherein the liquid toner contains these charge control agents.

Furthermore, in another object of the present invention there are provided liquid toners that enable excellent image characteristics, and which toners enhance the positive charge of the resin, such as ELVAX®, based colored toners.

In embodiments, the present invention is directed to liquid developers comprised of a nonpolar liquid, pigment, resin, preferably thermoplastic resin, a PEO:PPO charge control agent, and a charge director, such as the aluminum salts of alkylated salicylic acid, like, for example, hydroxy bis[3,5-tertiary butyl salicylic] aluminate, or a mixture of the aluminum salts of alkylated salicylic acid, like, for example, hydroxy bis[3,5-tertiary butyl salicylic] aluminate and EMPHOS PS-900™, reference U.S. Pat. No. 5,563,015, the disclosure of which is totally incorporated herein by reference.

More specifically, the present invention relates to a positively charged liquid developer comprised of a nonpolar liquid, thermoplastic resin particles, the triblock copolymer charge control agent, an optional charge adjuvant, optional pigment, and a charge director comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

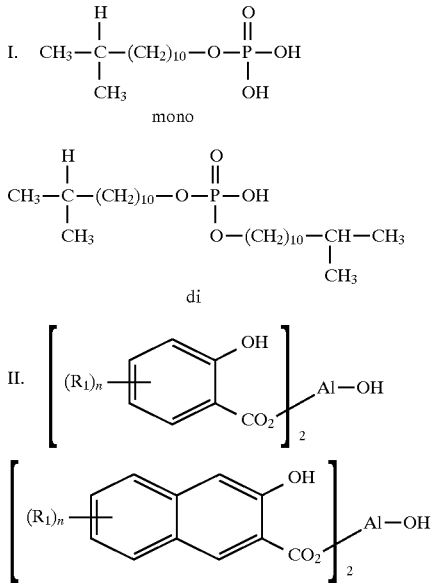

wherein $R_1$ is selected from the group consisting of hydrogen and alkyl, and n represents a number, such as from about 1 to about 6.

Of importance with respect to the present invention is the selection of the PEO:PPO charge control agent, which agent is mixed with the toner resin and pigment, and thereafter a charge director is added thereto. PEO:PPO examples are poly(ethylene oxide-b-propylene oxide-b-ethylene oxide) triblock copolymers of the formula $(CH_2—CH_2—O)_x—(CH_2—CHCH_3—O)_y—(CH_2—CH_2—O)_x$ wherein x and y represent the average number of ethylene oxide and propylene oxide repeat units in each of their respective blocks or segments. In the triblock copolymer formula representative of the Pluronic series available from BASF, the preferred PEO:PPO:PEO triblock copolymer charge control agent is Pluronic F-108 (Table 1) in which x and y are about 132 and 52, respectively, when the average triblock copolymer molecular weight ($M_w$) is about 14,600 and the two ethylene oxide blocks are of about equal length and comprise about 80 weight percent of the total triblock copolymer molecular weight. Specifically, the BASF F108 is believed to possess an $M_w$ of 14,600 with 30 weight percent of PEO and a melting point of 56° C.

Examples of PEO-PPO-PEO triblock copolymer compositions available from BASF are illustrated in Table 1, wherein L designates liquid and F designates prill or spherical pellets (solid), and x and y are the average degrees of polymerization or DPs for the PEO and PPO blocks, respectively.

TABLE 1

Pluronic PEO-PPO-PEO Triblock Copolymer Compositions

| BASF PEO-PPO-PEO Triblock Copolymer | Approximate Total $M_w$ of Triblock Copolymer | Approximate $M_w$ of Propylene Oxide Block | Approximate Wt. % of Both Ethylene Oxide Blocks | Approximate $DP_{ave}$ for PEO (x) & PPO (y) Blocks x | y |
|---|---|---|---|---|---|
| L-35 | 1900 | 900 | 50 | 11.3 | 15.5 |
| F77 | 6600 | 2100 | 70 | 51.1 | 36.2 |
| F-87 | 7700 | 2400 | 70 | 60.2 | 41.3 |
| F-127 | 12600 | 3600 | 70 | 102.1 | 62.0 |
| F-38 | 4700 | 900 | 80 | 43.1 | 15.5 |
| F-68 | 8400 | 1800 | 80 | 74.9 | 31.0 |
| F-88 | 11400 | 2400 | 80 | 102.1 | 41.3 |
| F-98 | 13000 | 2700 | 80 | 116.9 | 46.5 |
| F-108 | 14600 | 3000 | 80 | 131.7 | 51.7 |

Triblock copolymers can be of three physical forms including solids, pastes, and liquids and tend to be solids at molecular weights of 4,700 and higher when the ethylene oxide content is about 80 weight percent and the propylene oxide content is about 20 weight percent (F-38 in Table 1). Generally, as the propylene oxide content increases and/or the triblock copolymer molecular weight decreases, the triblock copolymer tends to become paste like and eventually a liquid at very low molecular weights. The preferred triblock PEO-PPO-PEO copolymer charge control agents for the invention liquid developers are solids with low PPO contents (less than or equal to 50 weight percent and more preferably less than or equal to 30 weight percent). Less preferred triblock PEO-PPO-PEO copolymer charge control agents are pastes which are mixtures of liquids and solids. The solid triblock copolymers are less likely to be washed out of the toner particle (solid phase) into the developer carrier fluid (liquid phase) and will be better retained within the toner or solids particles and/or on the surface of the toner particles wherein the charge control agent can easily perform its normal function of modulating toner charging. Higher PPO content (>50 weight percent) triblock copolymers are more hydrophobic and thus are more likely to be hydrocarbon carrier fluid miscible which increases the probability of some charge control agent wash out from the surface of the solid particles. Maintaining the charge control agent in the particles, or on the particle surface enables maximum developer charge modulation and minimum charge exchange between undesirably located charge control agent in the carrier fluid and desirably located charge director in the carrier fluid. Charge exchange between components in the carrier fluid can cause undesirable high supernatant conductivities and low optical density in prints obtained from liquid developers participating in the charge exchange. In principle, higher molecular weight PEO-PPO-PEO triblock copolymers may also be selected. For example, when the PEO content is maintained at 80 weight percent and the x and y values are 1,056 and 416, respectively, a triblock copolymer molecular weight of about 117,000 results.

The triblock polymer charge control agents can be selected as mixtures, for example from 1 to about 99 weight percent of one triblock, and from about 99 to 1 of a second triblock. In embodiments, the $M_w$ of the polypropylene oxide block and the polyethylene oxide block are from about 2,000 to about 50,000 at any weight percent composition for each block wherein the resulting PEO-PPO-PEO triblock copolymer is a solid or paste.

In embodiments of the present invention, the PEO:PPO is selected in various effective amounts, such as for example from about 0.05 to about 10, and preferably from about 3 to about 7 weight percent based on the total weight percent of the solids of resin, pigment, and PEO:PPO. For example, when 5 weight percent of PEO:PPO is selected, 55 weight percent of resin, and 40 weight percent of pigment is selected.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^9$ ohm-centimeters and a dielectric constant below 3.0 in embodiments of the present invention. Moreover, the vapor pressure at 25° C. should be less than 10 Torr in embodiments.

While the ISOPAR® series liquids can be the preferred nonpolar liquids for use as dispersant in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 85 to about 99.9 percent, and preferably from about 90 to about 99 percent by weight of the total developer dispersion, however, other effective amounts may be selected. The total solids, which include resin, pigment and the PEO:PPO Y charge control additive content of the developer in embodiments is, for example, 0.1 to 15 percent by weight, preferably 0.3 to 10 percent, and more preferably, 0.5 to 10 percent by weight.

Typical suitable thermoplastic toner resins can be selected for the liquid developers of the present invention in effective amounts, for example, in the range of about 99.9 percent to about 40 percent, and preferably 80 percent to 50 percent of developer solids comprised of thermoplastic resin, pigment, charge control agent, and in embodiments other components that may comprise the toner. Generally, developer solids include the thermoplastic resin, pigment and charge control agent. Examples of resins include polyesters, especially the SPAR polyesters, commercially available, and see for example U.S. Pat. No. 3,590,000, the disclosure of which is totally incorporated herein by reference; reactive extruded polyesters, with a gel amount of from about 10 to about 40 percent, and other gel amounts, or substantially no gel, reference U.S. Pat. No. 5,376,494, the disclosure of which is totally incorporated herein by reference; ethylene vinyl acetate (EVA) copolymers (ELVAX® resins, E.I. DuPont de Nemours and Company, Wilmington, Del.); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof.

The liquid developers of the present invention may optionally contain, and preferably does contain in embodiments a colorant dispersed in the resin particles. Colorants, such as pigments or dyes and mixtures thereof, are preferably present to render the latent image visible.

The colorant, preferably pigment, may be present in the toner in an effective amount of, for example, from about 0.1 to about 60 percent, and preferably from about 10 to about 50, and in embodiments 40 percent by weight based on the total weight of solids contained in the developer. The amount of colorant used may vary depending on the use of the developer. Examples of pigments which may be selected include carbon blacks available from, for example, Cabot Corporation, FANAL PINK™, PV FAST BLUE™, pigments as illustrated in U.S. Pat. No. 5,223,368, the disclosure of which is totally incorporated herein by reference; other known pigments; and the like.

Examples of charge directors present in various effective amounts of, for example, from about 0.001 to about 5, and preferably from about 0.005 to about 1 weight percent or parts, include aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis [monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis [monoalkylated hydroxy naphthoic acid] aluminate; bis [dialkylated hydroxy naphthoic acid] aluminate wherein alkyl preferably contains 1 to about 6 carbon atoms; bis [trialkylated hydroxy naphthoic acid] aluminate wherein alkyl preferably contains 1 to about 6 carbon atoms; bis [tetraalkylated hydroxy naphthoic acid] aluminate wherein alkyl preferably contains 1 to about 6 carbon atoms; and the like in admixture with EMPHOS PS-900TM.

To further increase the toner particle charge and, accordingly, increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. These types of adjuvants can assist in enabling improved toner charging characteristics, namely, an increase in particle charge that results in improved electrophoretic mobility for improved image development and transfer to allow superior image quality with improved solid area coverage and resolution in embodiments. The adjuvants can be added to the toner particles in an amount of from about 0.1 percent to about 15 percent of the total developer solids, and preferably from about 3 percent to about 7 percent of the total weight percent of solids contained in the developer.

The liquid electrostatic developer of the present invention can be prepared by a variety of processes such as, for example, mixing in a nonpolar liquid the thermoplastic resin, charge control agent, and colorant in a manner that the resulting mixture contains, for example, about 30 to about 60 percent by weight of solids; heating the mixture to a temperature of from about 40° C. to about 110° C. until a uniform dispersion is formed; adding an additional amount of nonpolar liquid sufficient to decrease the total solids concentration of the developer to about 10 to about 30 percent by weight; cooling the dispersion to about 10° C. to about 30° C.; adding the aluminum charge director compound to the dispersion; and diluting the dispersion.

In the initial mixture, the resin, colorant and charge control agent may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 30 to about 60 percent solids. This mixture is then subjected to elevated temperatures during the initial mixing procedure to plasticize and soften the resin. The mixture is sufficiently heated to provide a uniform dispersion of all the solid materials of, for example, colorant, charge director, charge control, and resin. However, the temperature at which this step is undertaken should not be so high as to degrade the nonpolar liquid or decompose the resin or colorant if present. Accordingly, the mixture in embodiments is heated to a temperature of from about 50° C. to about 110° C., and preferably from about 50° C. to about 80° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 30 percent by weight.

The dispersion is then cooled to about 10° C. to about 30° C., and preferably to about 15° C. to about 25° C., while mixing is continued until the resin admixture solidifies or hardens. Upon cooling, the resin admixture precipitates out of the dispersant liquid. Cooling is accomplished by methods such as the use of a cooling fluid like water, glycols such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 4 hours. Additional liquid may be added at any time during the preparation of the liquid developer to facilitate grinding or to dilute the developer to the appropriate percent solids needed for developing. Thereafter, the charge director is added. Other processes of preparation are generally illustrated in U.S. Pat. Nos. 4,760,009; 5,017,451; 4,923,778; 4,783,389, the disclosures of which are totally incorporated herein by reference.

As illustrated herein, the developers or inks of the present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating. The developers of the present invention are especially useful in the Xerox Corporation ColorgrafX Systems 8900 series printers, especially the 8936.

Disclosed is a positively charged liquid developer comprised of a nonpolar liquid, resin, pigment, a charge director, and a charge control agent comprised of a poly(ethylene oxide-b-propylene oxide-b-ethylene oxide) triblock copolymer; a developer wherein the poly(ethylene oxide-b-propylene oxide-b-ethylene oxide) triblock copolymer is a solid, and is of the formula $(CH_2—CH_2—O)_x—(CH_2—CHCH_3—O)_y—(CH_2—CH_2—O)_x$ wherein x and y represent the number of ethylene oxide and propylene oxide repeat segments, respectively; a developer wherein x is from about 43 to about 1,056 and y is from about 16 to about 416, and the triblock copolymer possesses a ($M_w$) molecular weight range of from about 4,700 to about 11,7000 when the triblock copolymer has a composition of about 80 percent polyethylene oxide (PEO) and about 20 percent polypropylene oxide (PPO); a liquid developer wherein the liquid has a viscosity of from about 0.5 to about 20 centipoise and resistivity equal to or greater than about $5\times10^9$, and the resin has a volume average particle diameter of from about 0.1 to about 30 microns; a developer wherein the resin is a copolymer of ethylene and vinyl acetate; a developer wherein the pigment is present in an amount of from about 0.1 to about 60 percent by weight based on the total weight of the developer solids; a developer wherein the pigment is carbon black, cyan, magenta, yellow or mixtures thereof; a developer wherein the charge control agent is present in an amount of from about 0.05 to about 10 weight percent based on the weight of the developer solids of resin, pigment and charge control agent; a developer wherein the liquid for the developer is an aliphatic hydrocarbon; a developer wherein the aliphatic hydrocarbon is a mixture of branched hydrocarbons of from about 8 to about 16 carbon atoms, or a mixture of normal hydrocarbons of from about 8 to about 16 carbon atoms; a developer wherein the aliphatic hydrocarbon is a mixture of branched hydrocarbons of from about 8 to about 16 carbon atoms; a developer wherein the resin is an alkylene polymer, a styrene polymer, an acrylate polymer, a polyester, or mixtures thereof; an imaging method which comprises forming an electrostatic latent image followed by the development thereof with the liquid developer illustrated herein; an ionographic imaging method which comprises charging a receptor followed by the development thereof with the developer illustrated herein; a developer wherein the charge director is a nonpolar liquid soluble organic aluminum complex; a developer wherein the charge director is comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

I.

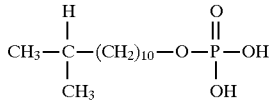

mono

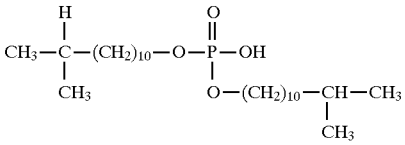

di

II.

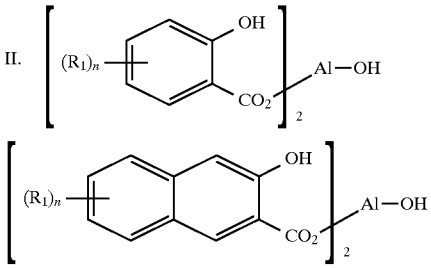

wherein $R_1$ is selected from the group consisting of hydrogen and alkyl, and n represents a number; a developer containing a charge adjuvant; a positively charged liquid developer comprised of a nonpolar liquid, thermoplastic resin particles, pigment, a charge director, and a charge control agent comprised of poly(ethylene oxide-b-propylene oxide-b-ethylene oxide) copolymer with an $M_w$ of from greater than about 4,700 to about 117,000 when the PPO content is less than or equal to about 50 percent; a developer wherein the copolymer is of the formula $(CH_2—CH_2—O)_x—(CH_2—CHCH_3—O)_y—(CH_2—CH_2—O)_x$ wherein x and y represent the average number of consecutive structural repeat units in a block of polyethylene oxide (PEO) or polypropylene oxide (PPO); a developer wherein the weight percent of PEO-PPO-PEO polyethylene oxide/polypropylene oxide/polyethylene oxide is 40/20/40 and the $M_w$ thereof is 12,000; wherein the weight percent of PEO-PPO-PEO is 40/20/40 and the $M_w$ thereof is 6,000; wherein the weight percent of PEO-PPO-PEO is 30/20/50 and the $M_w$ thereof is 12,000; wherein the weight percent of PEO-PPO-PEO is 60/20/20 and the $M_w$ thereof is 12,000; wherein the weight percent of PEO-PPO-PEO is 30/20/50 and the $M_w$ thereof is 12,000; wherein the weight percent of PEO-PO-PEO is 30/40/30 and the $M_w$ thereof is 6,000; wherein the weight percent of PEO-PPO-PEO is 50/20/30 and the $M_w$ thereof is 12,000; or wherein the weight percent of PEO-PPO-PEO is 10/40/50 and the $M_w$ thereof is 6,000; a developer wherein the poly(ethylene oxide-b-propylene oxide-b-ethylene oxide) triblock copolymer charge control agent is a solid, and x and y are greater than about 11.3 and about 15.5 for PEO and PPO, respectively, when the triblock copolymer $M_w$ is greater than 1,900 and the PPO composition is less than or equal to about 50 weight percent; a positively charged liquid developer wherein the charge control is comprised of mixtures of said poly(ethylene oxide-b-propylene oxide-b-ethylene oxide); a positively charged liquid developer wherein the charge director is comprised of a mixture of I. a nonpolar liquid soluble organic phosphate mono and diester mixture derived from phosphoric acid and isotridecyl alcohol, and II. a nonpolar liquid soluble organic aluminum complex of the formulas

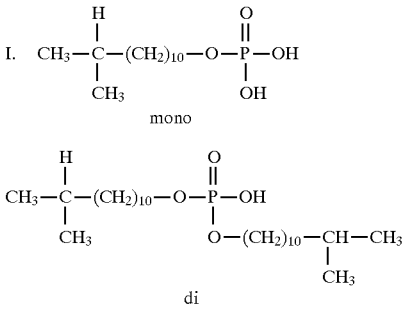

and a liquid developer comprised of the charge control agent poly(ethylene oxide-b-propylene oxide-b-ethylene oxide) triblock copolymer.

Embodiments of the invention will be illustrated in the following nonlimiting Examples. The toner particle size can range from about 0.1 to about 3.0 micrometers and the preferred particle size range is about 0.5 to about 1.5 micrometers. Particle size, when measured, was measured by a Horiba CAPA-500 centrifugal automatic particle analyzer manufactured by Horiba Instruments, Inc., Irvine, Calif. The total developer charge (Q in microcoulombs) was measured using the series-capacitor technique. The charge in all samples was measured at 400 volts for 0.05 second.

Series-Capacitor Technique

The electrical properties of liquid developers can be reviewed using a series-capacitor method, which is a well-established method for determining the dielectric relaxation time in partially conductive materials as, for example, might be found in "leaky" capacitors, reference U.S. Pat. No. 5,459,077, the disclosure of which is totally incorporated herein by reference.

Two series capacitors can be used. One is comprised of a dielectric layer (MYLAR®) which corresponds to the photoreceptor, the other is comprised of a layer of liquid (ink). Although a constant bias voltage is maintained across the two capacitors, the voltage across the ink layer decays as the charged particles within it move. Measurement of the external currents allows the observation of the decay of voltage across the ink layer. Depending on the composition of the ink layer, this reflects the motion of charged species, in real time, as in the various, actual liquid immersion development processes of this invention.

Application of a co-developed theoretical analysis, together with a knowledge of the dielectric thicknesses of the MYLAR® and ink layers, the applied bias voltage and the observed current, enables the measurement of the total collected charge (Q).

EXAMPLES

Controls 1A and 1B=40 Percent of Rhodamine Y Magenta: No CCA

One hundred sixty-two (162.0) grams of ELVAX 200W® (a copolymer of ethylene and vinyl acetate with a melt index at 190° C. of 2,500, available from E.I. DuPont de Nemours & Company, Wilmington, Del.), 108.0 grams of the magenta pigment (Sun Rhodamine Y 18:3 obtained from Sun Chemicals) and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. (Centigrade throughout) for 2 hours. 675 Grams of ISOPAR-G® were added to the attritor at the conclusion of 2 hours, and cooled to 23° C. by running water through the attritor jacket, and ground in the attritor for an additional 2 hours. Additional ISOPAR-G®, about 300 grams, was added and the mixture was separated from the steel balls.

To 293.54 grams of the mixture (14.308 percent solids) were added 2,499.46 grams of ISOPAR-G® (Exxon Corporation), and 7.0 grams of 1:1 Alohas/PS-900 (Witco) charge director (3 weight percent in ISOPAR-M®) to provide a charge director level of 5 milligrams of charge director per gram of toner solids (Control 1A). After print testing the Control 1A developer, an additional 7.0 grams of 1:1 Alohas/PS-900 (Witco) charge director (3 weight percent in ISOPAR-M®) were added to this developer to give a charge director level of 10 milligrams of charge director per gram of toner solids (Control 1B). The Control 1B developer was then print tested in the same way as was the Control 1A developer. The charge of the resulting liquid toner or developer after print testing, in the Xerox Corporation 8936 throughout unless otherwise indicated, was measured by the series capacitance method and was found to be 0.30 for the Control 1A developer and 0.26 for the Control 1B developer.

Alohas is an abbreviated name for hydroxy bis(3,5-di-tertiary butyl salicylic) aluminate monohydrate, reference for example U.S. Pat. Nos. 5,366,840 and 5,324,613, the disclosures of which are totally incorporated herein by reference.

Examples

Examples 1A and 1B=40 Percent of Rhodamine Y Magenta: 5 Percent of PEO:PPO (Pluronic F-108):

One hundred forty-eight point five (148.5) grams of ELVAX 200W® (a copolymer of ethylene and vinyl acetate with a melt index at 190° C. of 2,500, available from E.I. DuPont de Nemours & Company, Wilmington, Del.), 108.0 grams of the magenta pigment (Sun Rhodamine Y 18:3), 13.5 grams of the charge additive PEO:PPO (Pluronic F-108), and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. 675 Grams of ISOPAR-G® were added to an attritor at the conclusion of the 2 hours, and cooled to 23° C. by running water through the attritor jacket, and ground in the attritor for an additional 2 hours. Additional ISOPAR-G®, about 300 grams, was added and the mixture was separated from the steel balls.

To 289.94 grams of the mixture (14.486 percent solids) were added 2503.06 grams of ISOPAR-G® (Exxon Corporation), and 7.0 grams of 1:1 Alohas/PS-900 (Witco) charge director (3 weight percent in ISOPAR-M®) to provide a charge director level of 5 milligrams of charge director per gram of toner solids (Example 1A). After print testing the Example 1A developer, an additional 7.0 grams of 1:1 Alohas/PS-900 (Witco) charge director (3 weight percent in ISOPAR-M®) were added to this developer to give a charge director level of 10 milligrams of charge director per gram of toner solids (Example 1B). The Example 1B developer was then print tested on the 8936 of Control 1A. The charge of the resulting liquid toner or developer after print testing was measured by the series capacitance method, and was found to be 0.40 for the Example 1A developer and 0.46 for the Example 1B developer.

The Xerox ColorgrafX System 8936 is a 36 inch wide multiple pass ionographic printer. The printer parameters were adjusted to obtain a contrast of 50 and a speed of 2.0 ips by inputting values on the control panel. After single pass prints were made with the above parameter settings using the standard test printing mode (sail patterns), the residual development voltage was measured using an Electrostatic Volt Meter (Trek Model No. 565). This value is shown as residual voltage [($V_{out}$)]. This parameter is valuable because it is a measurement used to predict the amount of undesired color shifting (also referred to as staining) of the developed toner layer upon subsequent development passes. The reflective optical density (ROD), a color intensity measurement of chroma, was measured with a MacBeth 918 color densitometer using the substrate paper background as a reference. The paper used to test print these images was Rexham 6262.

A series of measurements were accomplished with the following results:

For Control 1A, which contained 40 weight percent of Rhodamine Y magenta pigment and zero weight percent of CCA, and wherein the milligrams of charge director per gram of toner solids was 5/1; 1:1 by weight of Alohas/PS-900, the total charge of the developer in microcoulombs was 0.30, the reflective optical density was 1.36, and the residual voltage was 65.

For Control 1B, which contained 40 weight percent of Rhodamine Y magenta pigment and zero weight percent of CCA, and wherein the milligrams of charge director per gram of toner solids was 10/1; 1:1 by weight of Alohas/PS-900, the total charge of the developer in microcoulombs was 0.26, the reflective optical density was 1.34, and the residual voltage was 55.

For Example 1A, which contained 40 weight percent of Rhodamine Y magenta pigment and 5 weight percent of PEO:PPO (Pluronic F-108) CCA, and wherein the milligrams of charge director per gram of toner solids was 5/1; 1:1 by weight of Alohas/PS-900, the total charge of the developer in microcoulombs was 0.40, the reflective optical density was 1.35, and the residual voltage was 42.

For Example 1B, which contained 40 weight percent of Rhodamine Y magenta pigment and 5 weight percent of PEO:PPO (Pluronic F-108) CCA, and wherein the milligrams of charge director per gram of toner solids was 10/1; 1:1 by weight of Alohas/PS-900, the total charge of the developer in microcoulombs was 0.46, the reflective optical density was 1.32, and the residual voltage was 35.

For improved image quality in multilayered images, it is preferred that RODs increase or stay the same, which permits more intense color or chroma, and $V_{outs}$ decrease, which minimize color staining or hue shifts of a magenta image after overcoating said magenta image with a yellow toner. The thickness of a developed layer, for example yellow, is dependent upon the charging level (proportional to applied voltage) on the dielectric receptor. Since a constant voltage is generally applied to the dielectric receptor in development of all layers in a multilayered image, large residual voltages, as might occur after development of the magenta layer, add to the applied voltage resulting in a thicker yellow layer. A thicker yellow layer overlaid on the thinner magenta layer can cause the latter to color shift towards orange. Review of the measurements and data presented herein indicates that increasing the charge director level in the no CCA magenta control developers, Controls 1A and 1B, failed to increase the developer charging levels (total Q), and reflective optical densities (ROD) of the developed magenta images remained essentially constant. When 5 percent PEO:PPO (Pluronic F-108) CCA was incorporated into what was otherwise the same magenta developer formulations as were used in Controls 1A and 1B, Examples 1A and 1B magenta developers were produced with charging levels of 0.40 and 0.46 versus 0.30 and 0.26 for the corresponding Control developers 1A and 1B when using the same charge director (CD) and levels thereof. Although the RODs of the developed magenta layers decreased only slightly in Examples 1A and 1B versus Controls 1A and 1B, the residual voltages ($V_{out}$) on the developed magenta toner layers decreased significantly to 42 and 35 volts, down from 65 and 55 volts in the corresponding no CCA developers in Controls 1A and 1B. By increasing the magenta developer charging level in Example 1B to 0.46 from 0.26 in Control 1B, it is believed that the conductivity of the developer also increased slightly causing the developed magenta layer residual voltage in Example 1B to decrease, while having little effect on reflective optical density (ROD of 1.32) versus Control 1B (ROD of 1.34). Side by side inspection of Example 1B and Control 1B (magenta images overcoated with yellow images) images indicated a visually observable color shift of the Control 1B image toward orange versus the Example 1B image when both sets of prints were made using identical machine printing parameters.

The incorporation of the PEO:PPO (Pluronic F-108) charge control agents into the developer formulation modulates the initial developer charging level to a new developer charging level having essentially the same reflective optical density, but a lower residual voltage as was found for the PEO:PPO (Pluronic F-108) developers. Thus, this charge control agent simultaneously tunes the charging level (total Q), reflective optical density (ROD) and residual voltage ($V_{out}$).

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. A positively charged liquid developer comprised of a nonpolar liquid, resin, colorant, a charge director, and a charge control agent comprised of poly(ethylene oxide-b-propylene oxide-b-ethylene oxide) triblock copolymer.

2. A developer in accordance with claim 1 wherein said poly(ethylene oxide-b-propylene oxide-b-ethylene oxide) triblock copolymer is a solid, and is of the formula $(CH_2—CH_2—O)_x—(CH_2—CHCH_3—O)_y—(CH_2—CH_2—O)_x$ wherein x and y represent the number of ethylene oxide and propylene oxide repeat segments, respectively.

3. A developer in accordance with claim 2 wherein x is from about 43 to about 1,056 and y is from about 16 and to about 416, and said triblock copolymer possesses a ($M_w$) molecular weight range of from about 4,700 to about 11,7000 when the triblock copolymer has a composition of about 80 percent polyethylene oxide (PEO) and about 20 percent polypropylene oxide (PPO).

4. A liquid developer in accordance with claim 2 wherein said liquid has a viscosity of from about 0.5 to about 20 centipoise and resistivity equal to or greater than about $5\times10^9$, and said resin has a volume average particle diameter of from about 0.1 to about 30 microns.

5. A developer in accordance with claim 2 wherein the resin is a copolymer of ethylene and vinyl acetate.

6. A developer in accordance with claim 1 wherein the colorant is present in an amount of from about 0.1 to about 60 percent by weight based on the total weight of the developer solids.

7. A developer in accordance with claim 1 wherein the colorant is carbon black, cyan, magenta, yellow or mixtures thereof.

8. A developer in accordance with claim 1 wherein the charge control agent is present in an amount of from about 0.05 to about 10 weight percent based on the weight of the developer solids of resin, colorant and charge control agent.

9. A developer in accordance with claim 1 wherein the liquid for said developer is an aliphatic hydrocarbon.

10. A developer in accordance with claim 9 wherein the aliphatic hydrocarbon is a mixture of branched hydrocarbons of from about 8 to about 16 carbon atoms, or a mixture of normal hydrocarbons of from about 8 to about 16 carbon atoms.

11. A developer in accordance with claim 9 wherein the aliphatic hydrocarbon is a mixture of branched hydrocarbons of from about 8 to about 16 carbon atoms.

12. A developer in accordance with claim 1 wherein the resin is an alkylene polymer, a styrene polymer, an acrylate polymer, a polyester, or mixtures thereof.

13. An imaging method which comprises forming an electrostatic latent image followed by the development thereof with the liquid developer of claim 1.

14. An ionographic imaging method which comprises charging a receptor followed by the development thereof with the developer of claim 1.

15. A developer in accordance with claim 1 wherein said charge director is a nonpolar liquid soluble organic aluminum complex.

16. A developer in accordance with claim 1 wherein said charge director is comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

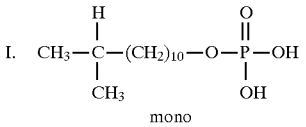

mono

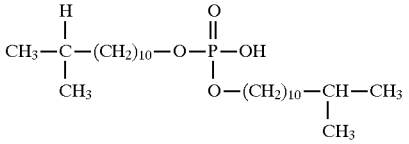

di

-continued

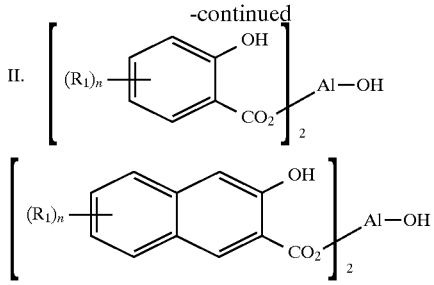

wherein $R_1$ is selected from the group consisting of hydrogen and alkyl, and n represents a number.

17. A developer in accordance with claim 1 further containing a charge adjuvant.

18. A positively charged liquid developer comprised of a nonpolar liquid, thermoplastic resin particles, colorant, a charge director, and a charge control agent comprised of poly(ethylene oxide-b-propylene oxide-b-ethylene oxide) copolymer with an Mw of from greater than about 4,700 to about 117,000 when the PPO content is less than or equal to about 50 percent.

19. A developer in accordance with claim 18 wherein said copolymer is of the formula $(CH_2—CH_2—O)_x—(CH_2—CHCH_3—O)_y—(CH_2—CH_2—O)_x$ wherein x and y represent the average number of consecutive structural repeat units in a block of polyethylene oxide (PEO) or polypropylene oxide (PPO), respectively.

20. A developer in accordance with claim 1 wherein the weight percent of PEO-PPO-PEO polyethylene oxide/polypropylene oxide/polyethylene oxide is 40/20/40 and the $M_w$ thereof is 12,000; wherein the weight percent of PEO-PPO-PEO is 40/20/40 and the $M_w$ thereof is 6,000; wherein the weight percent of PEO-PPO-PEO is 30/20/50 and the $M_w$ thereof is 12,000; wherein the weight percent of PEO-PPO-PEO is 60/20/20 and the $M_w$ thereof is 12,000; wherein the weight percent of PEO-PPO-PEO is 30/20/50 and the $M_w$ thereof is 12,000; wherein the weight percent of PEO-PO-PEO is 30/40/30 and the $M_w$ thereof is 6,000; wherein the weight percent of PEO-PPO-PEO is 50/20/30 and the $M_w$ thereof is 12,000; or wherein the weight percent of PEO-PPO-PEO is 10/40/50 and the $M_w$ thereof is 6,000.

21. A developer in accordance with claim 2 wherein the poly(ethylene oxide-b-propylene oxide-b-ethylene oxide) triblock copolymer charge control agent is a solid, and x and y are greater than about 11.3 and about 15.5 for PEO and PPO, respectively, when the triblock copolymer $M_w$ is greater than 1,900 and the PPO composition is less than or equal to about 50 weight percent.

22. A positively charged liquid developer in accordance with claim 1 wherein said charge control is comprised of mixtures of said poly(ethylene oxide-b-propylene oxide-b-ethylene oxide).

23. A positively charged liquid developer in accordance with claim 18 wherein said charge director is comprised of a mixture of I. a nonpolar liquid soluble organic phosphate mono and diester mixture derived from phosphoric acid and isotridecyl alcohol, and II. a nonpolar liquid soluble organic aluminum complex of the formulas

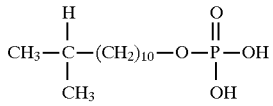

mono

-continued

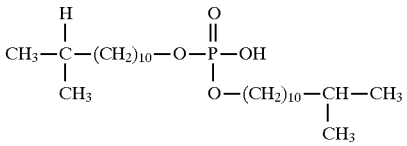

di

II.

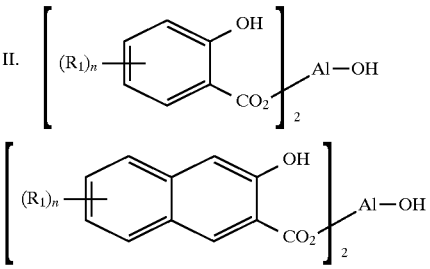

wherein $R_1$ is selected from the group consisting of hydrogen and alkyl, and n represents a number.

24. A positively charged liquid developer comprised of a nonpolar liquid, resin, colorant, a charge director, and a charge control agent comprised of poly(ethylene oxide-b-propylene oxide-b-ethylene oxide) triblock copolymer of the formula $$(CH_2—CH_2—O)_x—(CH_2—CHCH_3—O)_y—(CH_2—CH_2—O)_x$$

wherein x and y represent the number of ethylene oxide and propylene oxide repeat segments, respectively, and wherein x is from about 43 to about 1,056 and y is from about 16 and to about 416, and said triblock copolymer possesses a ($M_w$) molecular weight range of from about 4,700 to about 11,7000 when the triblock copolymer has a composition of about 80 percent polyethylene oxide (PEO) and about 20 percent polypropylene oxide (PPO).

25. A liquid developer in accordance with claim 24 wherein said colorant is a pigment or a dye.

* * * * *